US009625175B2

(12) United States Patent
Desmond et al.

(10) Patent No.: US 9,625,175 B2
(45) **Date of Patent: *Apr. 18, 2017**

(54) CURB ADAPTER

(71) Applicant: Cox Engineering Company, Canton, MA (US)

(72) Inventors: Jon Desmond, Canton, MA (US); Brett O'Brien, Bourne, MA (US); Brennan Richard, Norton, MA (US); Harold O. Seymour, Strafford, NH (US); Dave Fostello, Abington, MA (US)

(73) Assignee: Cox Engineering Company, Canton, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/825,573

(22) Filed: Aug. 13, 2015

(65) Prior Publication Data

US 2016/0061486 A1 Mar. 3, 2016

Related U.S. Application Data

(63) Continuation of application No. 13/952,926, filed on Jul. 29, 2013, now Pat. No. 9,134,040.

(51) Int. Cl.

| | |
|---|---|
| ***F24F 13/32*** | (2006.01) |
| ***F24F 13/08*** | (2006.01) |
| ***E04D 13/00*** | (2006.01) |

(52) U.S. Cl.

CPC ..... *F24F 13/32* (2013.01); *E04D 13/00* (2013.01); *F24F 13/081* (2013.01)

(58) Field of Classification Search

CPC ..... F24F 13/32; E04D 13/00

See application file for complete search history.

(56) References Cited

U.S. PATENT DOCUMENTS

| | | | | |
|---|---|---|---|---|
| 3,212,425 | A | 10/1965 | Hazen et al. | |
| 3,219,143 | A * | 11/1965 | Bohanon | E04H 3/00 181/224 |
| 3,435,911 | A * | 4/1969 | Greenheck | F24F 13/075 181/224 |
| 3,647,247 | A | 3/1972 | Pintard et al. | |
| 3,749,908 | A * | 7/1973 | Esser | E04D 13/0315 220/4.03 |

(Continued)

FOREIGN PATENT DOCUMENTS

| | | |
|---|---|---|
| FR | 2590611 | 5/1987 |

OTHER PUBLICATIONS

Application and Prosecution history of U.S. Appl. No. 13/952,926, filed Jul. 29, 2013, by Jon Desmond, et al., entitled "Curb Adapter", which is stored in the United States Patent and Trademark Office (USPTO).

*Primary Examiner* — Jeanette E Chapman

(74) *Attorney, Agent, or Firm* — Onello & Mello LLP

(57) ABSTRACT

Provided is a curb adapter, comprising a first wall along a first direction of extension; a second wall along a second direction of extension that is different from the first direction of extension; and a corner support mechanism coupled at a corner that includes an edge of the first wall and an edge of the second wall. The corner support mechanism includes at least one fastener coupled to the edge of the first wall and at least one fastener coupled to the edge of the second wall.

18 Claims, 12 Drawing Sheets

(56) References Cited

U.S. PATENT DOCUMENTS 3,802,131 A * 4/1974 Resech ..... E04D 13/1415 52/200
4,199,907 A * 4/1980 Bains ..... B66B 11/0253 403/231
4,413,450 A 11/1983 Brower
4,428,166 A * 1/1984 Burghart ..... E04D 13/1407 52/19
4,470,230 A * 9/1984 Weisner ..... E04D 13/0315 206/509
4,887,399 A 12/1989 Berger et al.
5,016,406 A 5/1991 Calam et al.
5,148,647 A 9/1992 Rutledge
5,188,333 A 2/1993 Schumacher et al.
5,292,012 A 3/1994 Davis et al.
5,297,371 A * 3/1994 Borghetto ..... E04C 2/546 52/200
5,465,533 A * 11/1995 Rummo, Jr. ..... E04D 13/0315 248/676
5,687,514 A * 11/1997 Gillispie ..... E04D 13/0315 52/200
5,832,674 A 11/1998 Ledbetter et al.
6,041,557 A * 3/2000 Brown ..... E04D 13/0315 52/200
6,044,592 A * 4/2000 Strieter ..... E04D 13/031 248/237
6,543,187 B1 * 4/2003 Menzies ..... E04F 17/026 52/199
7,065,928 B1 * 6/2006 Lane ..... F24F 13/32 52/200
7,484,506 B2 * 2/2009 Besal ..... F24C 15/20 126/299 E
7,712,279 B2 5/2010 McClure
9,134,040 B2 * 9/2015 Desmond ..... F24F 13/32
2002/0139063 A1 * 10/2002 Crane ..... E04D 13/0335 52/106
2005/0055917 A1 * 3/2005 Dubensky ..... E04B 1/3483 52/302.1
2006/0042621 A1 * 3/2006 Besal ..... F24C 15/20 126/299 D
2006/0070315 A1 * 4/2006 McClure ..... E04D 13/0315 52/200
2008/0040993 A1 * 2/2008 Valentz ..... E04D 13/0315 52/200

* cited by examiner 108
120A
102

104
108
120A
102

104
108
120A
114
102

104
108
120A
116
102

104
108
120A
120D
106
120B
102

104
119
108
120A
120D
132
106
120B
102

CURB ADAPTER

RELATED APPLICATIONS

This application is a continuation application of U.S. patent application Ser. No. 13/952,926, filed on Jul. 29, 2013, the entire contents of which are incorporated herein by reference.

TECHNICAL FIELD

The present inventive concepts generally relate to rooftop air conditioning, and more particularly, to curb adapters for rooftop packaged air conditioning units.

BACKGROUND

A roof curb is well-known for including a raised frame that is installed on a roof surface to elevate and mount mechanical equipment, such as a heating, ventilation, and air conditioning (HVAC) units. A roof curb adapter can be installed to eliminate the need for the time-consuming process of removing a roof curb during an HVAC unit replacement.

SUMMARY

In accordance with an aspect, provided is a curb adapter comprising a first wall along a first direction of extension; a second wall along a second direction of extension that is different from the first direction of extension; and a corner support mechanism coupled at a corner that includes an edge of the first wall and an edge of the second wall. The corner support mechanism includes at least one fastener coupled to the edge of the first wall and at least one fastener coupled to the edge of the second wall.

In some embodiments, the first direction of extension is perpendicular to the second direction of extension.

In some embodiments, the fastener includes a rivet, a screw, a glued joint or seam, or a combination thereof.

In some embodiments, the curb adapter further comprises a gap between the first wall and the second wall, the corner support mechanism positioned at the gap.

In some embodiments, an outermost edge at the edge of the first wall and an outermost edge at the edge of the second wall are separate from each other such that the corner includes a gap between the first wall and the second wall, and wherein the corner support mechanism is positioned over the gap and maintains the gap between the first wall and the second wall.

In some embodiments, the curb adapter further comprises a relief cut at the corner of the first wall and the second wall.

In some embodiments, the curb adapter further comprises a third wall and a fourth wall coupled the first wall and the second wall, respectively; an interior region having a boundary comprising the first through fourth walls; a baffle at the interior region. The interior region comprises at least one of a supply transition region and a return transition region each having a boundary that includes the baffle and at least one of the first through fourth walls.

In some embodiments, the baffle includes a horizontal baffle and a vertical baffle.

In some embodiments, the vertical baffle is coupled to a midsection of the horizontal baffle, and the supply transition region and the return transition region each has a perimeter that includes the horizontal baffle, the vertical baffle and the at least one of the first wall and the second wall.

In some embodiments, the horizontal baffle and the vertical baffle each includes a finger locking mechanism, and wherein the finger locking mechanism of the horizontal baffle is coupled to the finger locking mechanism of the vertical baffle at the midsection of the horizontal baffle.

In some embodiments, the vertical baffle includes a rolled radius edge for directing an air flow through the curb adapter.

In some embodiments, the baffle includes a chamfered metal tab constructed and arranged for coupling with a metal component of the curb adapter.

In some embodiments, the metal component is at least one of a rail, the first wall, and the second wall.

In some embodiments, the baffle includes a plurality fold-over tabs that are removably coupled to the least one of the first wall and the second wall.

In some embodiments, the curb adapter further comprises a hemmed metal lifting lug coupled to at least one of the first wall and the second wall, the lifting lug constructed and arranged for receiving a hook or other mechanical device that applies a force to the lifting lug to move the curb adapter to a location.

In accordance with an aspect, provided is a curb adapter, comprising: a first wall, a second wall, a third wall, and a fourth wall coupled to each other at corners thereof; a plurality of corner support mechanisms coupled at the corners of the first through fourth walls, each the corner support mechanism including at least one fastener coupled to an edge of a wall of the first through fourth walls; an interior region that includes a boundary comprising the first through fourth walls; and a baffle positioned in the interior region, wherein: the interior region comprises a supply transition region and a return transition region each having a boundary that includes the baffle and at least one of the first through fourth walls.

In accordance with an aspect, provided is a method for assembling a curb adapter, comprising: positioning a first wall along a first direction of extension; positioning a second wall along a second direction of extension to form a corner at an edge of the first wall and an edge of the second wall; positioning a corner support mechanism at the corner at the edge of the first wall and the edge of the second wall; and applying at least one fastener between the corner support mechanism, the edge of the first wall, and the edge of the second wall to couple the corner support mechanism to the first wall and the second wall.

In accordance with an aspect, provided is a curb adapter, comprising: a first wall along a first direction of extension; a second wall along a second direction of extension that is different from the first direction of extension; and a corner support mechanism coupled at a corner that includes an edge of the first wall and an edge of the second wall, wherein a gap is present between the edge of the first wall and the edge of the second wall.

In some embodiments, the gap is present between the edges of the first and second walls over entire lengths of the first and second walls.

In some embodiments, the gap is present between the edges of the first and second walls over less than entire lengths of the first and second walls.

In some embodiments, the first direction of extension is perpendicular to the second direction of extension.

In some embodiments, the corner support mechanism includes at least one fastener coupled to the edge of the first wall and at least one fastener coupled to the edge of the second wall.

In some embodiments, the fastener includes a rivet, a screw, a glued joint or seam, or a combination thereof.

In some embodiments, the curb adapter further comprises a fluid-tight seal positioned at the corner.

In some embodiments, the curb adapter further comprises a relief cut at the corner of the first wall and the second wall.

In some embodiments, the curb adapter further comprises a third wall and a fourth wall coupled the first wall and the second wall, respectively; an interior region having a boundary comprising the first through fourth walls; and a baffle at the interior region. The interior region comprises at least one of a supply transition region and a return transition region each having a boundary that includes the baffle and at least one of the first through fourth walls.

BRIEF DESCRIPTION OF THE DRAWINGS

The foregoing and other objects, features and advantages of embodiments of the present inventive concepts will be apparent from the more particular description of preferred embodiments, as illustrated in the accompanying drawings in which like reference characters refer to the same elements throughout the different views. The drawings are not necessarily to scale, emphasis instead being placed upon illustrating the principles of the preferred embodiments.

FIGS. 7A, 7B, and 7C are perspective views of a corner of a curb adapter, wherein a corner support mechanism for joining corner surfaces of two adjacent walls of the curb adapter, in accordance with an embodiment;

DETAILED DESCRIPTION OF EMBODIMENTS

Figure 1A:
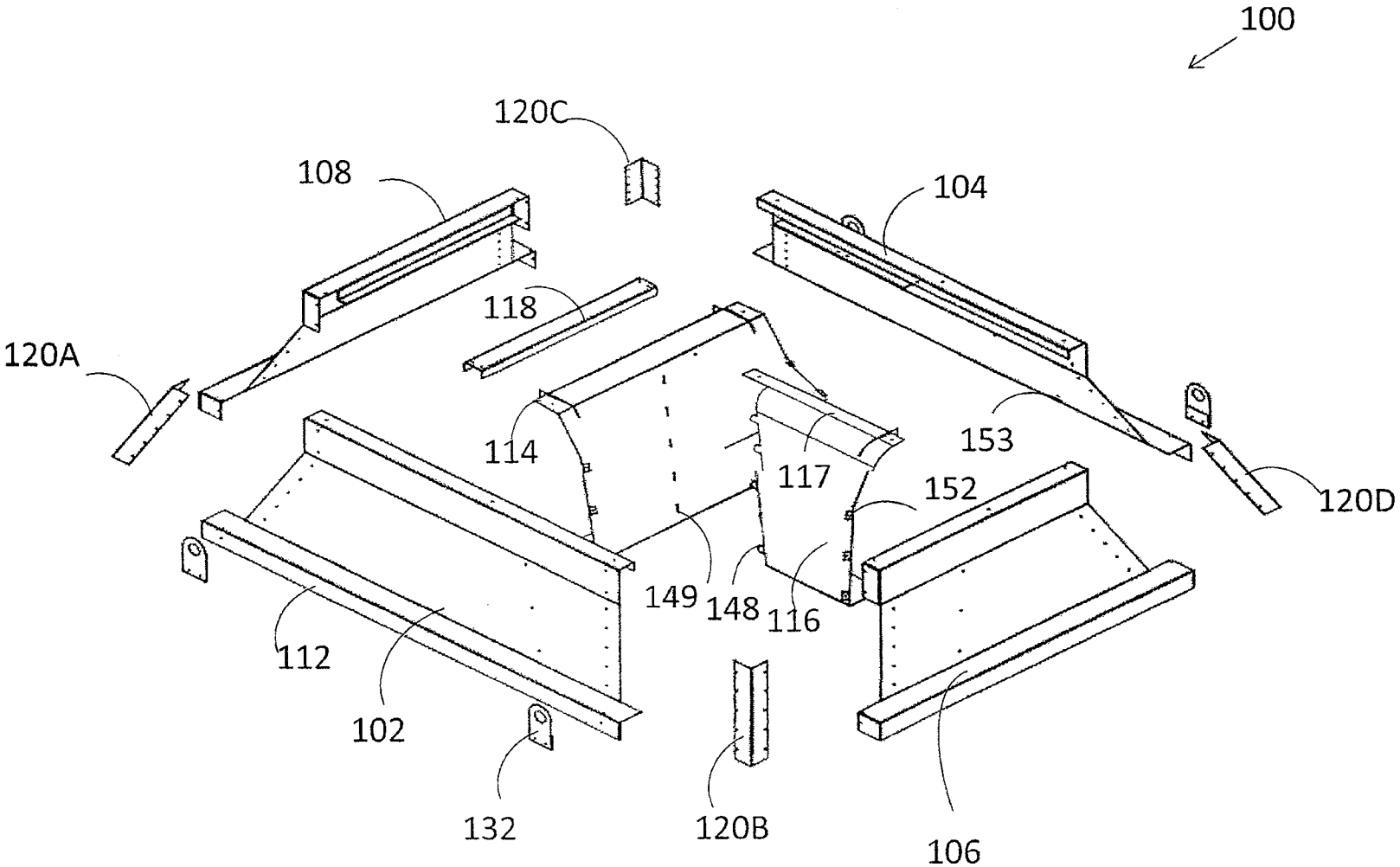
FIG. 1A is an exploded perspective view of a curb adapter, in accordance with an embodiment.

The terminology used herein is for the purpose of describing particular embodiments and is not intended to be limiting of the inventive concepts. As used herein, the singular forms "a," "an" and "the" are intended to include the plural forms as well, unless the context clearly indicates otherwise. It will be further understood that the terms "comprises," "comprising," "includes" and/or "including," when used herein, specify the presence of stated features, integers, steps, operations, elements, and/or components, but do not preclude the presence or addition of one or more other features, integers, steps, operations, elements, components, and/or groups thereof.

It will be understood that, although the terms first, second, third etc. may be used herein to describe various limitations, elements, components, regions, layers and/or sections, these limitations, elements, components, regions, layers and/or sections should not be limited by these terms. These terms are only used to distinguish one limitation, element, component, region, layer or section from another limitation, element, component, region, layer or section. Thus, a first limitation, element, component, region, layer or section discussed below could be termed a second limitation, element, component, region, layer or section without departing from the teachings of the present application.

It will be further understood that when an element is referred to as being "on" or "connected" or "coupled" to another element, it can be directly on or above, or connected or coupled to, the other element or intervening elements can be present. In contrast, when an element is referred to as being "directly on" or "directly connected" or "directly coupled" to another element, there are no intervening elements present. Other words used to describe the relationship between elements should be interpreted in a like fashion (e.g., "between" versus "directly between," "adjacent" versus "directly adjacent," etc.). When an element is referred to herein as being "over" another element, it can be over or under the other element, and either directly coupled to the other element, or intervening elements may be present, or the elements may be spaced apart by a void, space, or gap.

A conventional approach for replacing an aging roof-mounted air conditioning unit includes the removal of the existing unit and its associated roof curb. However, this requires a new curb to be installed along with any required duct work for the new unit. Thus, this approach requires expensive and time-consuming roofing modifications, and can lead to an increased risk of roof leaks.

Another approach is to install a curb adapter on top of an existing roof curb, thereby eliminating the need to replace the roof curb when installing a new air conditioning unit. Conventional curb adapters are configured to be fully insulated and seal-tight for protection against weather-related elements. However, the galvanized metal sheets that form the body of the curb adapter are welded together to form a seal at the corners of the curb adapter.

A disadvantage of forming a seal by welding is that significant heat is required to melt the metal, which can also break down the galvanized coating. A galvanized coating is important for preventing the underlying sheet metal from deteriorating, i.e., rust, when exposed to the environmental elements. Curb adapters that are welded are provided with poorly applied corrosion paint. Also, access is required to the internal structure, requiring disassembly. Here, the metal must be cut and re-welded to create a new seal. Other disadvantages associated with a welded curb adapter include the lack of aesthetics caused by welding with respect to galvanized paint, and a greater risk of leaks occurring from a poor-quality weld.

Embodiments of the present inventive concepts relate to a curb adapter that relies on mechanical fasteners rather than full seam welding to construct the adapter. Thus, a curb adapter can be assembled and disassembled without compromising the structural integrity of the material forming the adapter, e.g., galvanized sheet metal.

The ability to assemble and disassemble a curb adapter using mechanical fasteners provides customers with an option to receiving an unassembled curb adapter, reducing acquisition costs related to shipping the unassembled components and providing flexibility with respect to storage and transfer, and location of assembly, such as the location of use. Thus, a curb adapter can be assembled on-site, instead of being assembled at a manufacturing plant or other location then transported to the installation site. Transportation of the unassembled components can reduce the volume of the shipment as compared to the volume of an assembled unit.

A curb adapter in accordance with some embodiments can be constructed and arranged as a knock down (KD) field assembled curb adapter, since joints, seams, or other intersections of metal elements of the curb adapter are not welded, but are instead coupled by mechanical fasteners or the like. A fluid-tight seal, for example, a water-tight and/or air tight seal, can be provided at these regions by sealing compounds, for example, according to embodiments described herein.

Also, a galvanized coating on the metal components of the curb adapter is not compromised by welding so the risk of metal breakdown is eliminated. There is an additional design flexibility offered by using mechanical fasteners. Support mechanisms can provide reinforcement at an intersection of two metal components, for example, at a corner, and can be attached to each of the intersecting components using mechanical fasteners such as rivets, screws, glue, or the like.

Figure 1B:
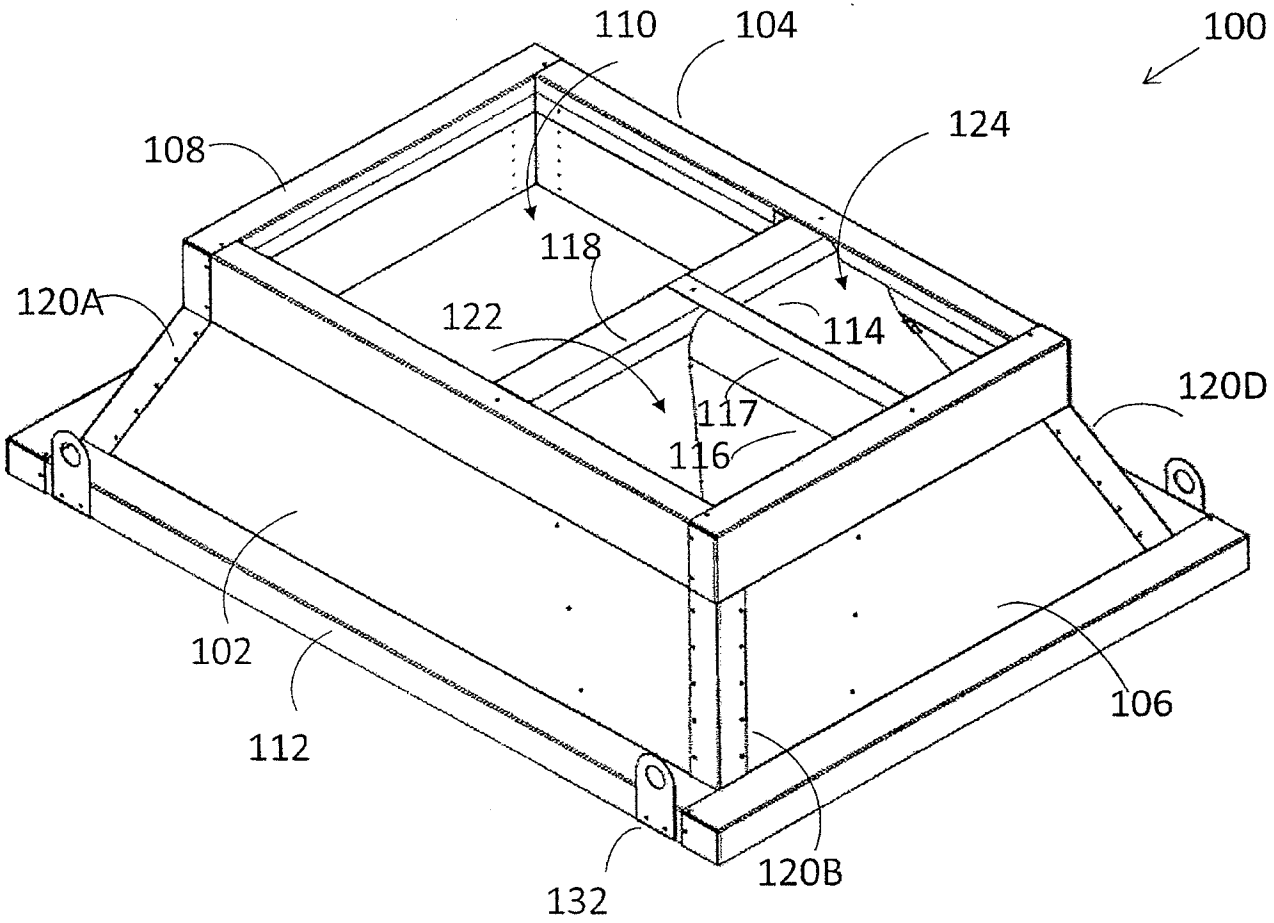
FIG. 1B is an assembled perspective view of the curb adapter of FIG. 1A in accordance with an embodiment.

FIG. 1A is an exploded perspective view of a curb adapter 100, in accordance with an embodiment. FIG. 1B is an assembled perspective view of the curb adapter 100 of FIG. 1A in accordance with an embodiment. The curb adapter 100 is constructed and arranged for positioning on a roof curb (see FIG. 3), which in turn is affixed to a roof structure. The curb adapter 100 can be constructed and arranged to receive an HVAC unit, fans, skylights, and/or other mechanical equipment, and provides an interface between the HVAC unit or the like and the roof curb, obviating the need for replacing the roof curb and an underlying infrastructure such as ducts or the like.

With reference to FIGS. 1A and 1B, an embodiment of the curb adapter 100 comprises a first wall 102, a second wall 104, a third wall 106, and a fourth wall 108. The walls 102, 104, 106, 108 can be formed of galvanized steel or other materials known to those of ordinary skill in the art that provide rigidity and other characteristics required for a curb adapter. The four walls 102, 104, 106, 106 can be constructed and arranged to be coupled at a 90 degree angle relative to each other. The top regions of the walls 102, 104, 106, 108 can collectively form a rectangular or square shape structure, or top boundary region. Bottom regions of the walls 102, 104, 106, 108 also form a rectangular or square shaped structure, or bottom boundary region. The first and second walls 102, 104 can have a similar length and/or other dimensions, and the third and fourth walls 106, 108 can have a similar length and/or other dimensions. The walls 102, 104, 106, 108 can each have a sloped surface or taper along their widths from their top regions to their bottom regions, respectively. The actual slope can depend on the size of the roof curb relative to the size of the mechanical unit to be mounted thereto, for example, shown in FIG. 3. The sloped configuration can provide water runoff, and can also add strength to the curb adapter 100 to support the weight of the unit positioned on the curb adapter. The curb adapter 100 can have different shapes, sizes, and configurations, for example, shown at FIG. 3, depending on its deployment, customer requirements, or other factors. For example, the curb adapter 100, depending on its configuration, can include three walls, or five or more walls.

Accordingly, in some embodiments, the bottom boundary region formed by the walls 102, 104, 106, 108 is greater than the top boundary region formed by the walls 102, 104, 106, 108. In other embodiments, the area of the bottom boundary region is less than that of the top boundary region. The top boundary region is divided into an insulation region 110, a supply transition region 122 and a return transition region 124. The supply transition region 122 and a return transition region 124 provide openings through which ducts, inlets, outlets, conduits, or the like can be received for providing air flow, liquid, electricity, and so on with respect to the unit. Insulation known to one of ordinary skill in the art can be inserted at the insulation region 110, for example, fiberglass insulation or a spray-on insulation foam material. In an embodiment, a closed cell high R value insulation can be inserted that meets NFPA 90 flame and smoke standards.

Each wall 102, 104,106, 106 can have a curb skirt 112, also referred to as a lip or rail, that extends from the wall surfaces 102, 104, 106, 108, respectively, to form a perimeter about the bottom boundary region of the curb adapter 100. The curb skirt 112 is constructed and arranged to extend over an existing curb as a counter flashing measure. A seal can be created when a gasket is applied. The seal can be an airtight seal and/or a watertight seal.

An optional cross-channel member 118 (shown in FIG. 1A), and/or rail 119 (shown in FIG. 2) extends across the opening at the top boundary region 110 is coupled to the first and second walls 102, 104, respectively, for providing structural integrity to the curb adapter 100.

Figure 8A:
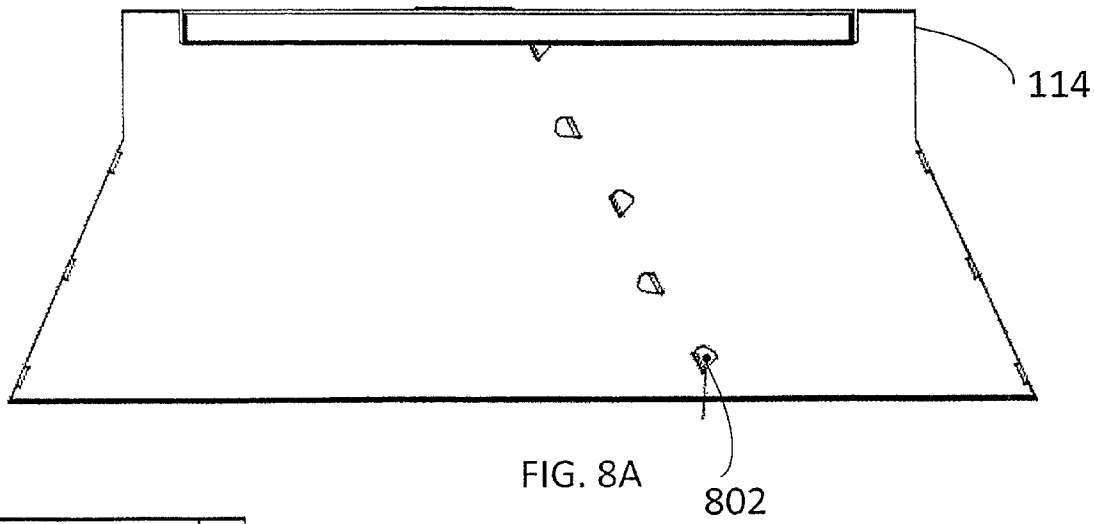
FIG. 8A is a front view of a horizontal baffle comprising a plurality of finger lock fastening mechanisms, in accordance with an embodiment.
Figure 8C:
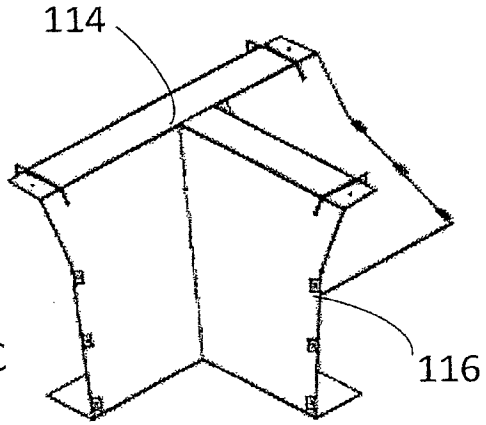
FIG. 8C is a perspective view of the horizontal baffle and the vertical baffle of FIG. 8B coupled together, in accordance with an embodiment.
Figure 8B:
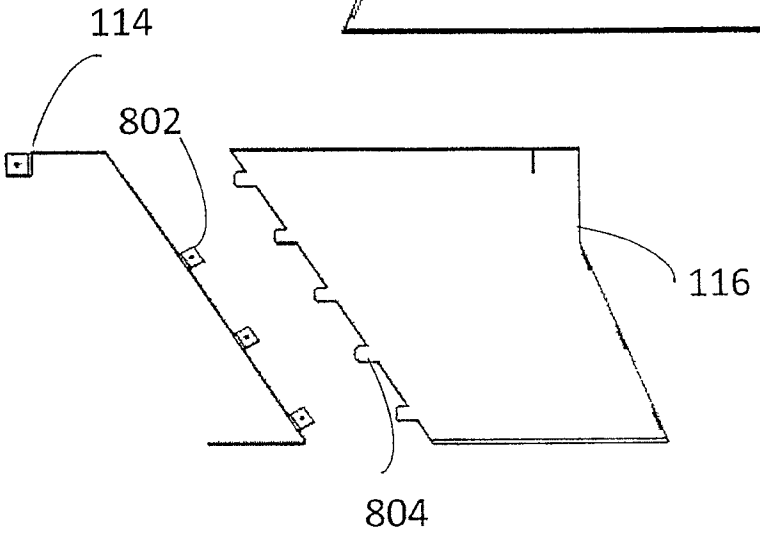
FIG. 8B is a view of a horizontal baffle and a vertical baffle each comprising a plurality of finger lock fastening mechanisms and separate from each other, in accordance with an embodiment.

A horizontal baffle 114 is coupled to the first and second walls 102, 104, respectively. A vertical baffle 116 is coupled to a midsection of the horizontal baffle 114 and the third wall 106. The horizontal baffle 114 can include a plurality of inserts 149 for receiving tabs 148 extending from the vertical baffle 116. In other embodiments, as shown in FIGS. 8A-8C, each of the horizontal baffle 114 and the vertical baffle 116 can include fastening mechanisms constructed and arranged to interlock with each other, thereby coupling the horizontal baffle 114 and the vertical baffle 116 to each other.

The supply transition region 122 and the return transition region 124 are formed by perimeters established by the horizontal baffle 114, the vertical baffle 116, and the third wall 106. In other embodiments, the supply 122 and return 124 transition regions are constructed and arranged to corresponding with openings in a mechanical unit, e.g., an air conditioner, and a roof curb positioned above and below the curb adapter 100, respectively, for exchanging air between the mechanical unit and a roof curb, for example, shown at FIG. 3.

The vertical baffle 116 includes a rolled radius edge 117 for directing an air stream, which provide for less turbulence and a reduced pressure drop in a duct system in communication with the curb adapter 100.

A plurality of corner support mechanisms 120A-120D (generally, 120) are provided, each coupled between a corner of two walls of the plurality of walls 102, 104, 106, 108. Each corner support mechanism 120 includes a plurality of holes for receiving a fastening mechanism such as a rivet, a blind rivet, a rubber grommetted tek screw, a non-grommetted tek screw, a bolt with a mating locking nut, or the like, for coupling the corner mechanism 120 to each wall surface forming the corner. Alternatively, or in addition, the corner can include a glued joint or seam. Other non-welded fastening techniques can equally apply.

In addition, water-tight sealing techniques can be applied. Sealants and sealing compounds such as silicone and/or other roofing sealants such as a water based duct sealant DP1010 or GacoFlex S-10 Solventless silicone coating can be applied to joints, seams, and/or other intersections between two or more metal elements of the curb adapter 100, such as a corner formed by a sidewall and an endwall. In some embodiments, the sealant can be applied between the outer surfaces of the walls 102, 104, 106, 108 at their corner regions and the inner surfaces of the corner mechanisms 120A-120D. In other embodiments, the sealant can be applied at inner and outer surfaces of the walls 102, 104, 106, 108 and corner mechanisms 120A-120D.

One or more lifting lugs 132 can be separately provided, and coupled, to the walls of the curb adapter 100. In an embodiment, the lifting lugs 132 are ship-hemmed sheet metal lifting lugs.

FIGS. 2A-2F are perspective views illustrating the assembly of a curb adapter, in accordance with an embodiment. In describing FIGS. 2A-2F, reference is made to FIGS. 1A-1E.

Figures 2A, 2B, 2C, 2D, 2E, 2F:
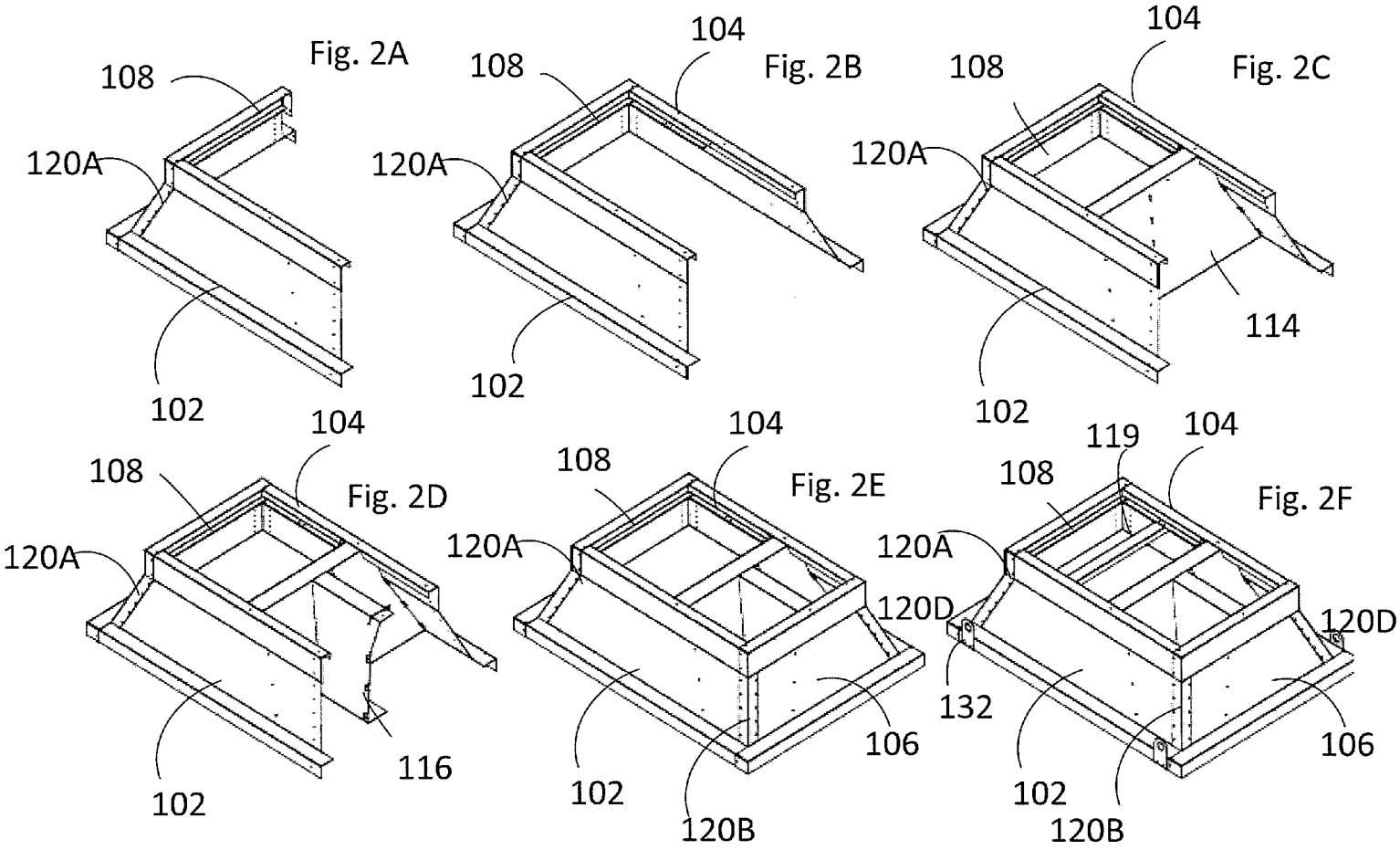
FIGS. 2A-2F are perspective views illustrating the assembly of a curb adapter, in accordance with an embodiment.

In FIG. 2A, one side of the first wall 102 is coupled to one side of the fourth wall 108 at a corner 202 by a corner bracket 120A. The first wall 102 and the fourth wall 108 can have a space or gap therebetween, but can nevertheless be held in place relative to each other by the corner bracket 120A. The first wall 102 includes a plurality of holes 702 that are aligned with a first row of holes of the corner bracket 120A, and the fourth wall 108 includes a plurality of holes 702 that are aligned with a second row of holes of the corner bracket 120A, for example, described in FIG. 7.

In FIG. 2B, one side of the second wall 104 is coupled to the other side of the fourth wall 108 at a corner by a corner bracket 120B. The second wall 104 and the fourth wall 108 can have a space or gap between them, but can nevertheless be held in place relative to each other by the corner bracket 120B that maintains the gap, thereby permitting some margin of error with respect to assembly. The second wall 104 includes a plurality of holes that are aligned with a first row of holes of the corner bracket 120B, and the fourth wall 108 includes a plurality of holes that are aligned with a second row of holes of the corner bracket 120A, for example, described in FIG. 7.

In FIG. 2C, the horizontal baffle 114 is coupled between a midregion of the first wall 102 and a midregion of the second wall 104. The horizontal baffle 114 can be coupled between the first wall 102 and the second wall 104 according to one or more embodiments described herein.

In FIG. 2D, the vertical baffle 116 is coupled to a midregion of the horizontal baffle 114 according to one or more embodiments described herein, for example, illustrated at FIG. 8.

In FIG. 2E, the third wall 106 is coupled to the first wall 102 and the second wall 104. Corner brackets 102B, 102D can be coupled to a corner of the first and third wall 102, 106 and a corner of the second and third wall 104, 106, respectively according to one or more embodiments described herein, in a similar manner as that described at FIGS. 2A and 2B. The first wall 102 and the third wall 106 can have a space or gap between them, but can nevertheless be held in place relative to each other by the corner bracket 120B. The second wall 104 and the third wall 106 can have a space or gap between them, but can nevertheless be held in place relative to each other by the corner bracket 120D.

In FIG. 2F, a plurality of lifting lugs 132 can be attached to a periphery of the curb adapter, for example, using fastening mechanisms such as screws, rivets, and so on. An optional cross-channel member 119 can be coupled between the first wall 102 and the second wall 104, for example, according to one or more techniques described herein.

Figure 3:
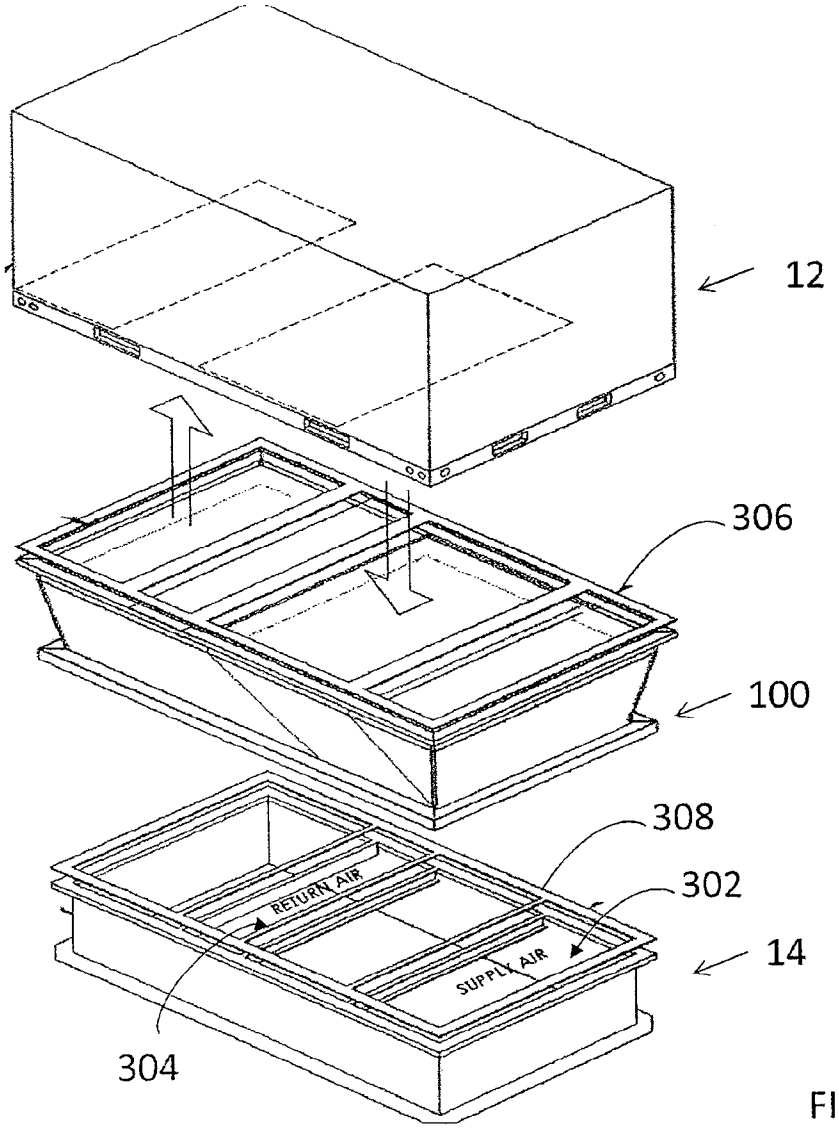
FIG. 3 is an exploded perspective view of a roof curb, a curb adapter, and an air conditioning unit, in accordance with an embodiment.

FIG. 3 is an exploded perspective view of a roof curb 14, a curb adapter 100, and an air conditioning unit 12, in accordance with an embodiment.

The roof curb 14, also referred to as a mounting curb or a base curb, includes a substantially rectangular framework, and is constructed and arranged as a foundation or support member for the air conditioning unit 12 when mounted on a roof. A gasket (not shown) can be positioned between the roof curb 14 and the roof. The configuration of the roof curb 14 is well-known to those of ordinary skill in the art. For example, the roof curb 14 includes a supply air transition region 302 and a return air transition region 304 that is coupled to corresponding ductwork or the like for transferring air between the air conditioning unit 12 and the building to which the roof curb 14 is attached. The roof curb 14 can be formed of galvanized steel or the like.

The curb adapter 100 is positioned on the roof curb 14. A gasket 308 can be positioned between the curb adapter 100 and the roof curb 14. Another gasket 306 can be positioned between the air conditioning unit 12 and the curb adapter 100. The return transition region 124 and the supply transition region 122 of the curb adapter 100 are in communication with, for example, aligned with, the return air transition region 304 and the supply air transition region 302, respectively, for providing a path for the transfer of air with the air conditioning unit 12.

Figure 4:
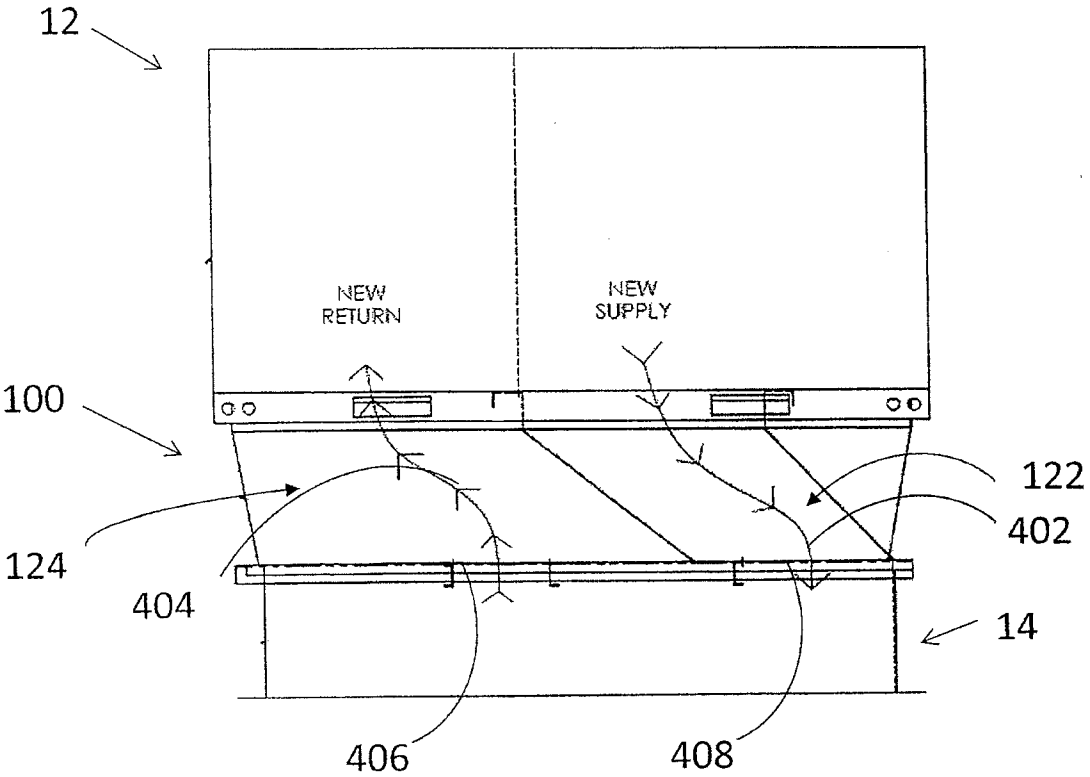
FIG. 4 is a cross-sectional view of the roof curb, a curb adapter, and an air conditioning unit of FIG. 3 coupled to each other and illustrating air flows through the roof curb, a curb adapter, and an air conditioning unit of FIG. 3, in accordance with an embodiment.

FIG. 4 is a cross-sectional view of the roof curb 14, a curb adapter 100, and an air conditioning unit 12 of FIG. 3 coupled to each other and illustrating air flows through the roof curb, a curb adapter, and an air conditioning unit of FIG. 3, in accordance with an embodiment.

As shown in FIGS. 1A and 1B, the curb adapter can be constructed and arranged so that a rolled radius edge 117 is at a leading edge of one, more than one, or all of the air streams. In FIG. 4, a first airflow path 402 is shown from a new supply at the air conditioning unit 12 through the supply transition region 122 of the curb adapter 100 to an existing supply 408 at the roof curb 14 to a duct or other air transfer apparatus. The rolled radius edge 117 can provide for less turbulence at the curb adapter 100, optimized aerodynamics, and/or reduced pressure drops. A second airflow path 404 is shown from an existing return 406 at the roof curb 14 through the return transition region 124 of the curb adapter 100 to a new return at the air conditioning unit 12.

Figure 5:
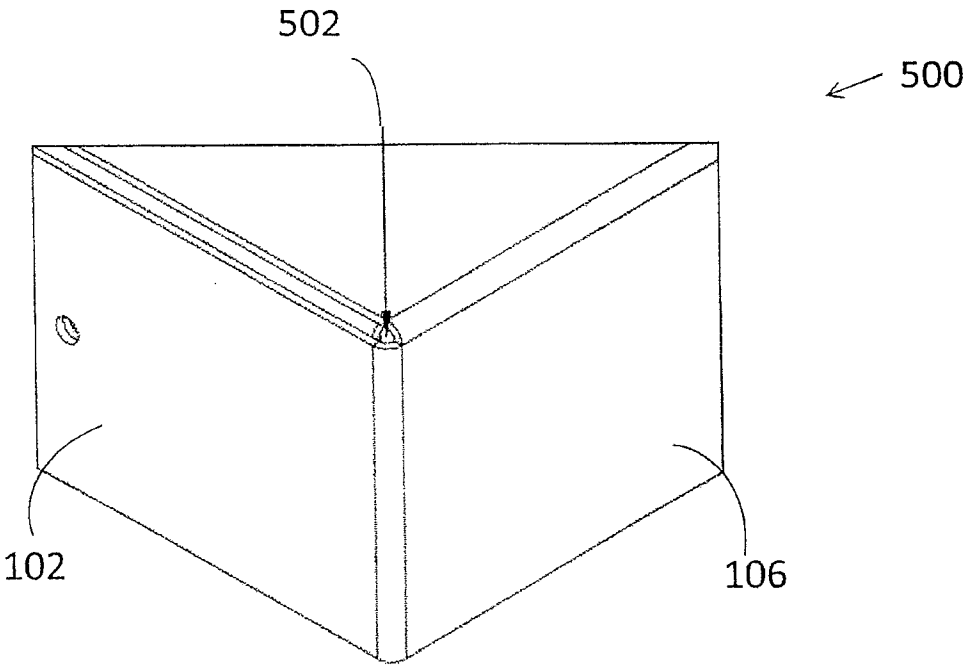
FIG. 5 is a perspective view of a corner region of a curb adapter having a relief cut, in accordance with an embodiment.

FIGS. 5A and 5B is a perspective view of a corner region of a curb adapter having a relief cut 502, in accordance with an embodiment. Two metal portions of the curb adapter can be joined at a region that has a relief cut 502. For example, a relief cut 502 can be at a corner where the first wall 102 and the third wall 106 of FIGS. 1A and 1B meet. The relief cut 502 can be circular, square, rectangular, or other shape. The relief cut 502 can allow for a greater assembly tolerance and ease of assembly during manufacturing by avoiding metal to metal conflicts or interferences. Configurations that are absent such relief cuts may result in a misshaped geometry, for example, caused by non-exact press break bends. Tolerance cuts permit metal portions to be assembled with ease, with little concern of margin of error.

Figure 6:
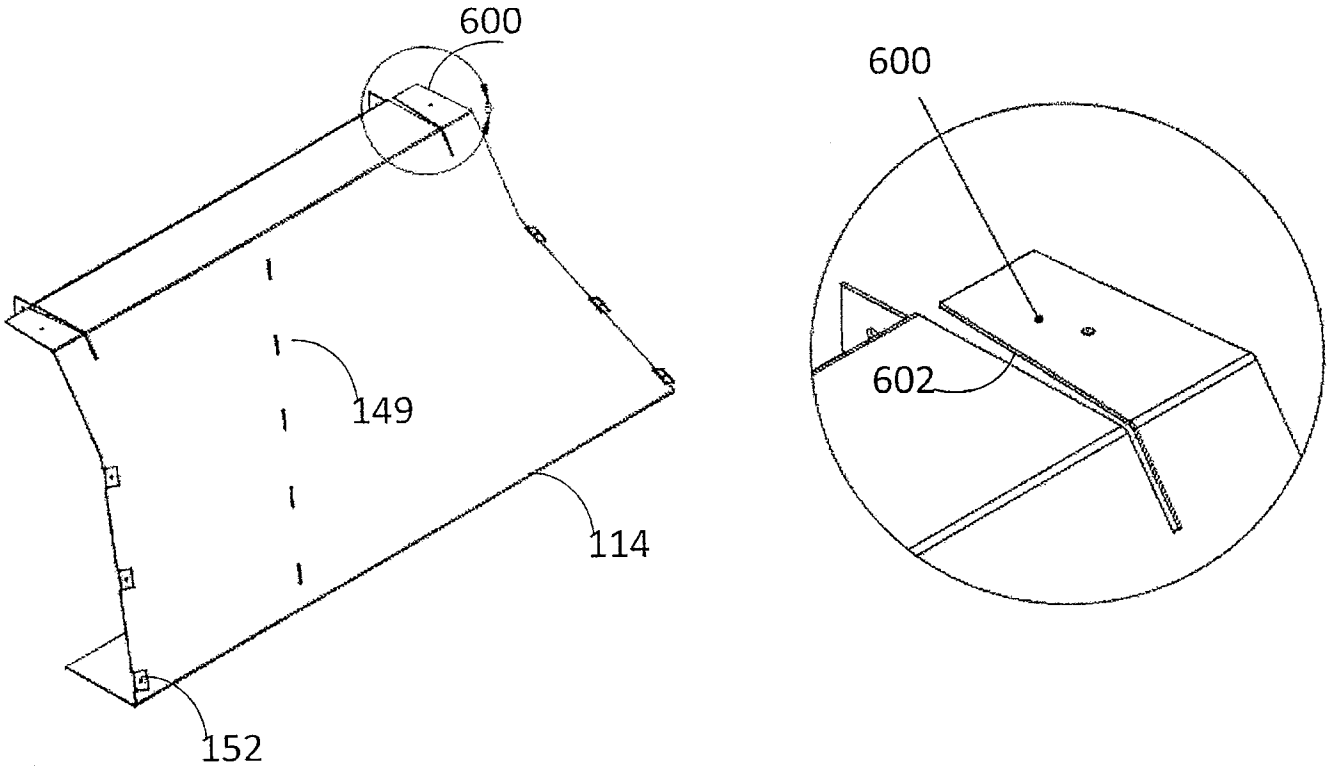
FIG. 6 is a view of a chamfered metal tab, in accordance with an embodiment.

FIG. 6 is a view of a chamfered metal tab 602 at a baffle 114 of a curb adapter, in accordance with an embodiment. Although a baffle is shown 114, one or more chamfers 602 can be formed at a wall, a rail, or other curb adapter component described herein. A chamfer 602 allows for "play" in the assembly, and may be cut in the edges of a metal tab 600, assisting in the guidance of the tab into a rail channel or other metal component of a curb adapter, for example, at a wall 104 shown in FIG. 1B.

Figure 7A:
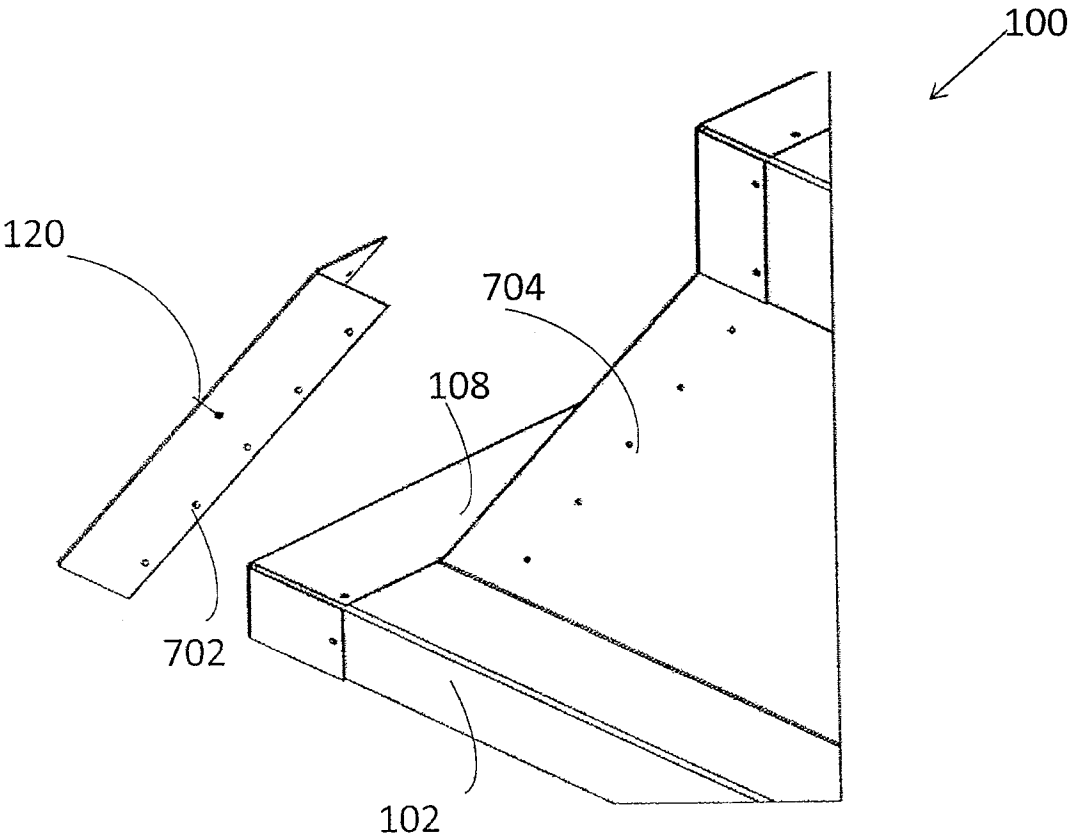
Figure 7B:
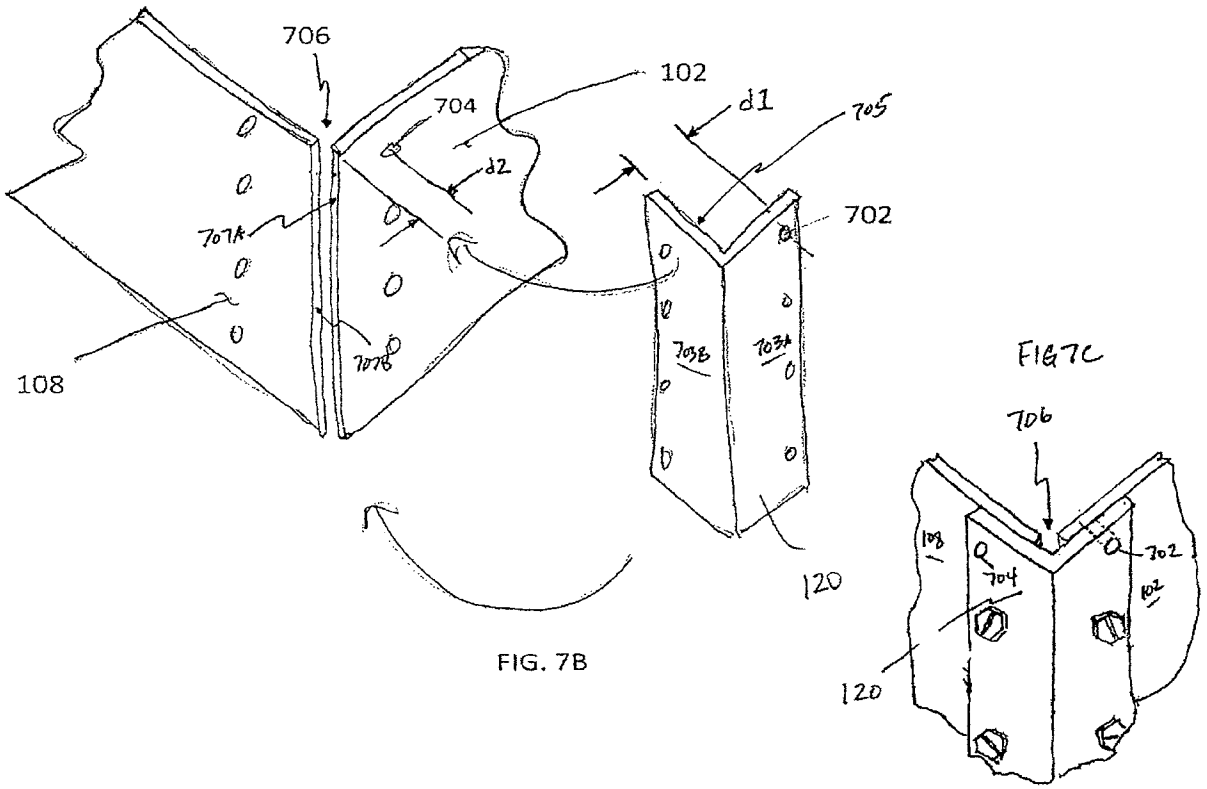

FIGS. 7A, 7B, and 7C are perspective views of a corner of a curb adapter 100, wherein a corner support mechanism 120 for joining corner surfaces of two adjacent walls 102, 108 of the curb adapter 100, in accordance with an embodiment. In describing FIGS. 7A and 7B, reference is made to elements of FIGS. 1A through 2. Although walls 102, 108 are shown and described, any sheet metal element of a curb adapter 100 can equally apply so long as the sheet metal element is constructed and arranged to abut or nearly abut another sheet metal element, and that each of the neighboring sheet metal elements are constructed and arranged to communicate with the corner support mechanism 120.

The corner support mechanism 120 includes a plurality of holes 702 for receiving a fastening mechanism such as a rivet, a blind rivet, a rubber grommetted tek screw, a non-grommetted tek screw, a bolt with a mating locking nut, or the like. Each of the first wall 102 and the neighboring second wall 108 has a wall surface edge that includes a plurality of alignment holes 704 that correspond with the holes 702 in the corner support mechanism 702. A fastening mechanism can extend through a hole 702 to terminate at a corresponding alignment hole 704 for coupling the corner mechanism 120 to a wall surface forming the corner. The corner at where the first wall 102 and second wall 108 meet or nearly meet can include a gap 706 that separates the first wall 102 and the second wall 108. The gap 706 can permit some margin of error with respect to a misalignment, a dimension differences between the walls 102, 108, while nevertheless permitting the corner region to be formed at the first wall 102 and the second wall 108.

Referring to FIG. 7B, it can be seen that two adjacent walls, namely the first 102 and fourth 108 walls, of the curb adapter 100 are placed in position for fastening by the corner support mechanism 120. The alignment holes 702 of the corner support mechanism 120 are positioned to align with corresponding alignment holes 704 of the corresponding first wall 102. In some embodiments, the distance between a center axis of an alignment hole 702 of a first portion 703A of the corner support mechanism 120 and an inner surface 705 of the second portion 703B of the corner support mechanism can be determined as distance d1. Also, a distance between a center axis of a corresponding alignment hole 704 on the first wall 102 and an edge 707 of the first wall can be determined as distance d2. In some embodiments, distance d1 is greater than distance d2. As a result a gap 706 is present between edges 707A, 707B of the first and fourth walls 102, 108 when the corner support mechanism 120 is coupled to them. FIG. 7C depicts the assembled corner region, including the gap 706.

In various embodiments, depending on the application, it may be desirable for a tighter gap 706 to be present. In some embodiments, the neighboring walls 102, 104, 106, 108 may be constructed and arranged in their corner regions such that their respective edges 707A, 707B make contact at some portions along the interface, and are separated by the gap 706 at other portions along their interface.

In addition, sealing techniques can be applied to the corner support mechanism 120 and/or the corner region formed by the edges of the first and second walls 102, 108, respectively. For example, a sealing compound such as a water based duct sealant DP1010 or GacoFlex S-10 solventless silicone coating can be applied.

FIG. 8A is a front view of a horizontal baffle 114 comprising a plurality of finger lock fastening mechanisms 802, in accordance with an embodiment. FIG. 8B is a view of a horizontal baffle 114 and a vertical baffle 116 each comprising a plurality of finger lock fastening mechanisms 802, 804, respectively, and separate from each other, in accordance with an embodiment. FIG. 8C is a perspective view of the horizontal baffle 114 and the vertical baffle 116 of FIG. 8B coupled together, in accordance with an embodiment.

In describing FIGS. 8A-8C, reference is made at least to elements of FIGS. 1A through 2. Referring again to FIG. 1A, the horizontal baffle 114 can be coupled to the vertical baffle 116 by the finger lock fastening mechanisms 802, 804, respectively. As shown in FIG. 8A, the finger lock fastening mechanisms 802 can be positioned along a mid-region of the horizontal baffle 114. As shown in FIG. 8B, the vertical baffle 116 can likewise include a plurality of finger lock fastening mechanisms 804, each aligned with a finger lock fastening mechanisms 802 of the horizontal baffle 114, so that the vertical baffle 116 can therefore be coupled to horizontal baffle 114 at the mid-section of the horizontal baffle 114 via the interlocking fastening mechanisms 802, 804.

Figure 9:
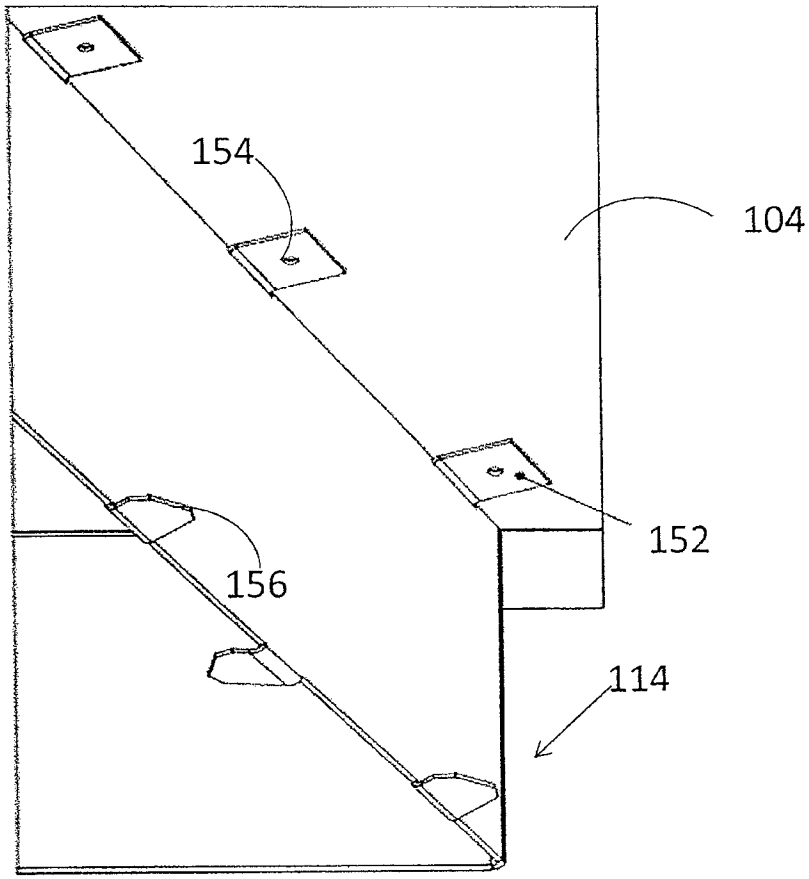
FIG. 9 is a perspective view of a baffle including fold-over tabs for positioning and anchoring with an interior sheet metal component, in accordance with an embodiment.

FIG. 9 is a perspective view of a baffle 114 including fold-over tabs 152 for positioning and anchoring with an interior sheet metal component, in accordance with an embodiment. The fold-over tabs 152 can extend from the baffle 114, which can be a horizontal baffle or a vertical baffle. The interior sheet metal component can be a wall, for example, wall 104 as shown in FIGS. 1A, 1B, and 9, or other metal component of the curb adapter 100 described herein, for example, shown in the exploded view of FIG. 1A. The fold-over tabs 152 can be used for the alignment and positioning of a baffle with the wall at which the baffle is coupled. For example, as shown in FIG. 1A, a wall 104 can include a plurality of guide holes that can be aligned with holes 154 extending through the tabs 152. A screw, rivet, or other fastening mechanism (not shown) can be inserted, for example, threaded, in the hole 154 in the fold-over tab 152 and coupled to the wall 104 via the guide hole (not shown) in the wall 104 for anchoring the fold-over tabs 152 to the wall 104, thereby affixing the baffle 114 to the wall 104. The baffle 114 can include a plurality of finger lock fastening mechanisms 156 similar to those described with respect to FIGS. 8A-8C, for attaching the baffle 114 to another baffle, for example, baffle 116 described herein.

Figure 10:
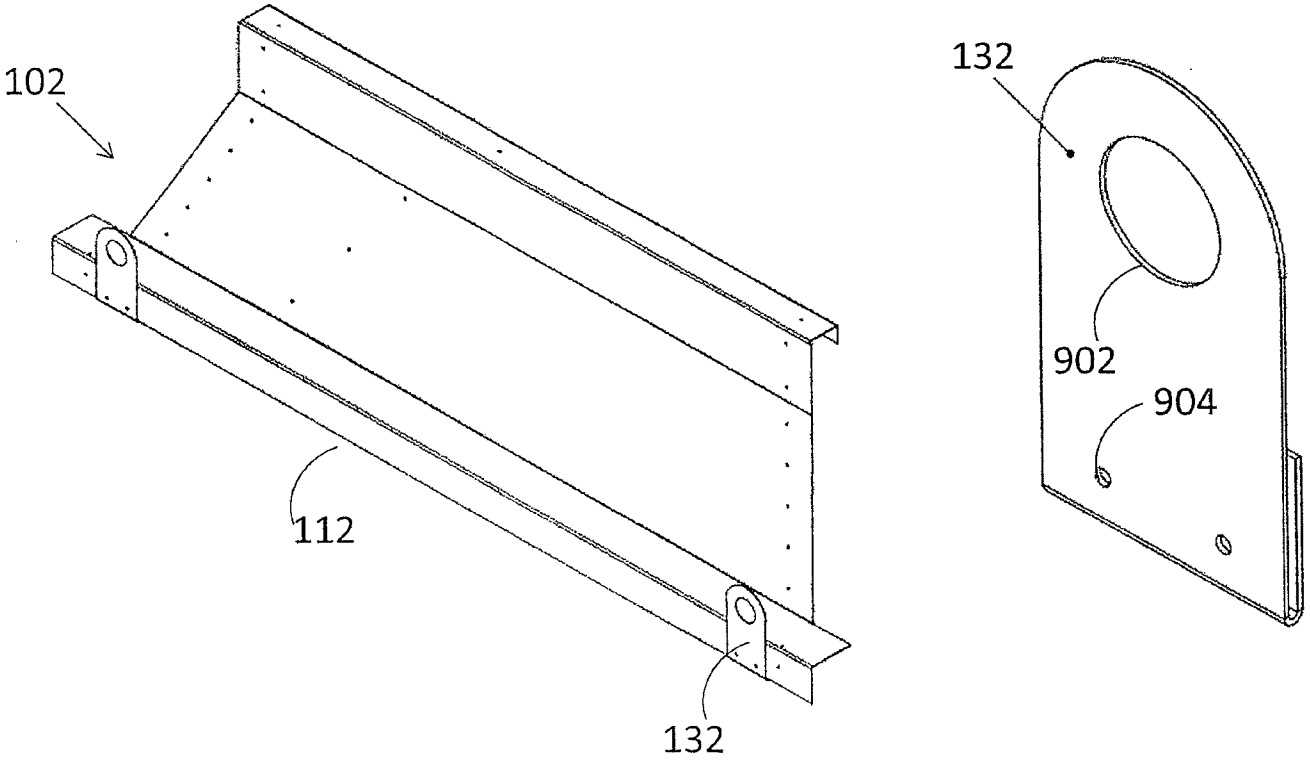
FIG. 10 is a perspective view of a curb adapter wall and a lifting lug coupled thereto, in accordance with an embodiment.

FIG. 10 is a perspective view of a curb adapter wall 102 and a lifting lug 132 coupled thereto, in accordance with an embodiment.

In some embodiments, one or more lifting lugs 132 can be attached to one or more walls of the curb adapter 100, or more specifically, to a lip or rail 112 of a wall. Although a wall 102 is shown in FIG. 10, one or more lifting lugs 132 can be coupled to other walls or sheet metal elements of the curb adapter 100.

A lifting lug 132 can include an opening 902 for receiving a hook or other mechanical device, which, when positioned at the opening 902 can apply a force for lifting at least a portion of the curb adapter 100, for example, for positioning on a roof curb as shown in FIG. 3. The lifting lug 132 can include two additional holes 904 for receiving a fastener such as a rivet, screw, or the like. The holes 904 can be aligned with guide holes in the wall 102 that receive the rivet, screw, or the like, and coupling the lifting lug 132 to the wall 102. In some embodiments, the lifting lug 132 is hemmed. The hemmed lifting lug 132 can be positioned over a metal rail or the like. Accordingly, the lifting lug 132 can be coupled permanently or removably coupled to different equipment, for example, large heavy mechanical equipment requiring movement from a current location to a new location.

While the present inventive concepts have been particularly shown and described above with reference to exemplary embodiments thereof, it will be understood by those of ordinary skill in the art, that various changes in form and detail can be made without departing from the spirit and scope of the present inventive concepts described and defined by the following claims.

What is claimed is:

1. A curb adapter, comprising:

a first wall along a first direction of extension;

a second wall along a second direction of extension that is different from the first direction of extension, wherein the first and second walls of the curb adapter each includes a curb skirt that is constructed and arranged to extend over a presently installed roof curb;

a gap between the first wall and the second wall providing for dimension differences or a misalignment between the first wall and the second wall;

a corner support mechanism positioned over the gap, the corner support mechanism coupled at a corner that includes the gap, an edge of the first wall, and an edge of the second wall, the corner support mechanism including at least one fastener coupled to the edge of the first wall and at least one fastener coupled to the edge of the second wall, the corner support mechanism extending between the curb skirt and the corner; and a supply transition region and a return transition region, each having a boundary that includes at least one of the first and second walls, the supply transition region and the return transition region each providing a flow path between the presently installed roof curb and a mechanical unit on an opposite side of the curb adapter as the presently installed roof.

2. The curb adapter of claim 1, wherein the first direction of extension is perpendicular to the second direction of extension.

3. The curb adapter of claim 1, wherein the fastener includes a rivet, a screw, a glued joint or seam, or a combination thereof.

4. The curb adapter of claim 1, further comprising a fluid-tight seal positioned at the corner.

5. The curb adapter of claim 1, wherein an outermost edge at the edge of the first wall and an outermost edge at the edge of the second wall are separate from each other such that the corner includes a gap between the first wall and the second wall, and wherein the corner support mechanism is positioned over the gap and maintains the gap between the first wall and the second wall.

6. The curb adapter of claim 1, further comprising a relief cut at the corner of the first wall and the second wall.

7. The curb adapter of claim 1, further comprising:

a third wall and a fourth wall coupled the first wall and the second wall, respectively;

an interior region having a boundary comprising the first through fourth walls; and a baffle at the interior region;

the interior region comprising at least one of the supply transition region and the return transition region each having a boundary that includes the baffle and at least one of the first through fourth walls.

8. The curb adapter of claim 7, wherein the baffle includes a horizontal baffle and a vertical baffle.

9. The curb adapter of claim 8, wherein the vertical baffle is coupled to a midsection of the horizontal baffle, and wherein the supply transition region and the return transition region each has a perimeter that includes the horizontal baffle, the vertical baffle and the at least one of the first wall and the second wall.

10. The curb adapter of claim 9, wherein the horizontal baffle and the vertical baffle each includes a finger locking mechanism, and wherein the finger locking mechanism of the horizontal baffle is coupled to the finger locking mechanism of the vertical baffle at the midsection of the horizontal baffle.

11. The curb adapter of claim 8, wherein the vertical baffle includes a rolled radius edge for directing an air flow through the curb adapter.

12. The curb adapter of claim 7, wherein the baffle includes a chamfered metal tab constructed and arranged for coupling with a metal component of the curb adapter.

13. The curb adapter of claim 12, wherein the metal component is at least one of a rail, the first wall, and the second wall.

14. The curb adapter of claim 7, wherein the baffle includes a plurality fold-over tabs that are removably coupled to the least one of the first wall and the second wall.

15. The curb adapter of claim 1, further comprising a hemmed metal lifting lug coupled to at least one of the first wall and the second wall, the lifting lug constructed and arranged for receiving a hook or other mechanical device that applies a force to the lifting lug to move the curb adapter to a location.

16. The curb adapter of claim 1, further comprising:

a top boundary region that includes a top surface of the first and second walls; and a bottom boundary region that includes a bottom surface of the first and second walls, the bottom boundary region having an area that is less than or greater than an area of the top boundary region, the curb skirts of the first and second walls forming a perimeter at the bottom boundary region.

17. A curb adapter, comprising:

a first wall along a first direction of extension;

a second wall along a second direction of extension that is different from the first direction of extension;

a gap between the first wall and the second wall;

a corner support mechanism positioned over the gap, the corner support mechanism coupled at a corner that includes the gap, an edge of the first wall, and an edge of the second wall, the corner support mechanism including at least one fastener coupled to the edge of the first wall and at least one fastener coupled to the edge of the second wall, the corner support mechanism extending between the curb skirt and the corner;

a top boundary region that includes a top surface of the first and second walls;

a bottom boundary region that includes a bottom surface of the first and second walls, the bottom boundary region having an area that is less than or greater than an area of the top boundary region, the bottom boundary region constructed and arranged to communicate with a roof curb; and a supply transition region and a return transition region, each having a boundary that includes at least one of the first and second walls, the supply transition region and the return transition region each providing a flow path between the roof curb and a mechanical unit on an opposite side of the curb adapter as the presently installed roof.

18. The curb adapter of claim 1, wherein the first wall, second wall, and corner support mechanism each includes an alignment hole, and wherein a dimension of the gap is determined by a distance of a combination of the alignment holes of the first wall, second wall, and corner support mechanism from each other.

* * * * *